United States Patent [19]

Warshawsky

[11] 4,453,204

[45] Jun. 5, 1984

[54] SUPPORT ASSEMBLY FOR LAMP SWING ARM

[76] Inventor: Jerome Warshawsky, 1322 Everitt Pl., Hewlett Harbor, N.Y. 11557

[21] Appl. No.: 503,411

[22] Filed: Jun. 13, 1983

[51] Int. Cl.[3] ..... F21V 21/00

[52] U.S. Cl. ..... 362/396; 248/296; 362/270; 362/285; 362/413; 362/414; 362/427; 362/431

[58] Field of Search ..... 362/270, 285, 396, 427, 362/431, 413, 414; 248/296

[56] References Cited

U.S. PATENT DOCUMENTS 4,386,393 5/1983 Pike ..... 362/427

4,424,555 1/1984 Krubsack et al. ..... 362/427 X

*Primary Examiner*—Stephen J. Lechert, Jr.

*Attorney, Agent, or Firm*—Stephen E. Feldman

[57] ABSTRACT

A swing arm support housing is formed with an upper housing assembly and a lower housing assembly. Each housing assembly includes a pair of openings spaced one from the other but each formed along parallel axis. One opening of the upper housing assembly extends into but not through the housing and is of a size and configuration to be mounted on top of a lamp support post. The other opening of the upper housing assembly extends completely through the housing and is fitted proximate one of its ends with a clamping ring that has a longitudinal slit to permit distortion of the ring, proximate the slit and in a radial direction, to clamp same against the lamp swing arm or hold the swing arm in selected positions. A clamping actuator extends into the housing along an axis perpendicular to the axis of said openings and at a position proximate the second opening to coact with the clamping ring proximate its slit to compress the ring against the lamp swing arm or release the ring therefrom. The lower housing assembly includes a guide ring to receive the lamp swing arm. The two housings are spaced from each other when mounted to the support post and when receiving the swing arm.

13 Claims, 5 Drawing Figures

FIG. 1
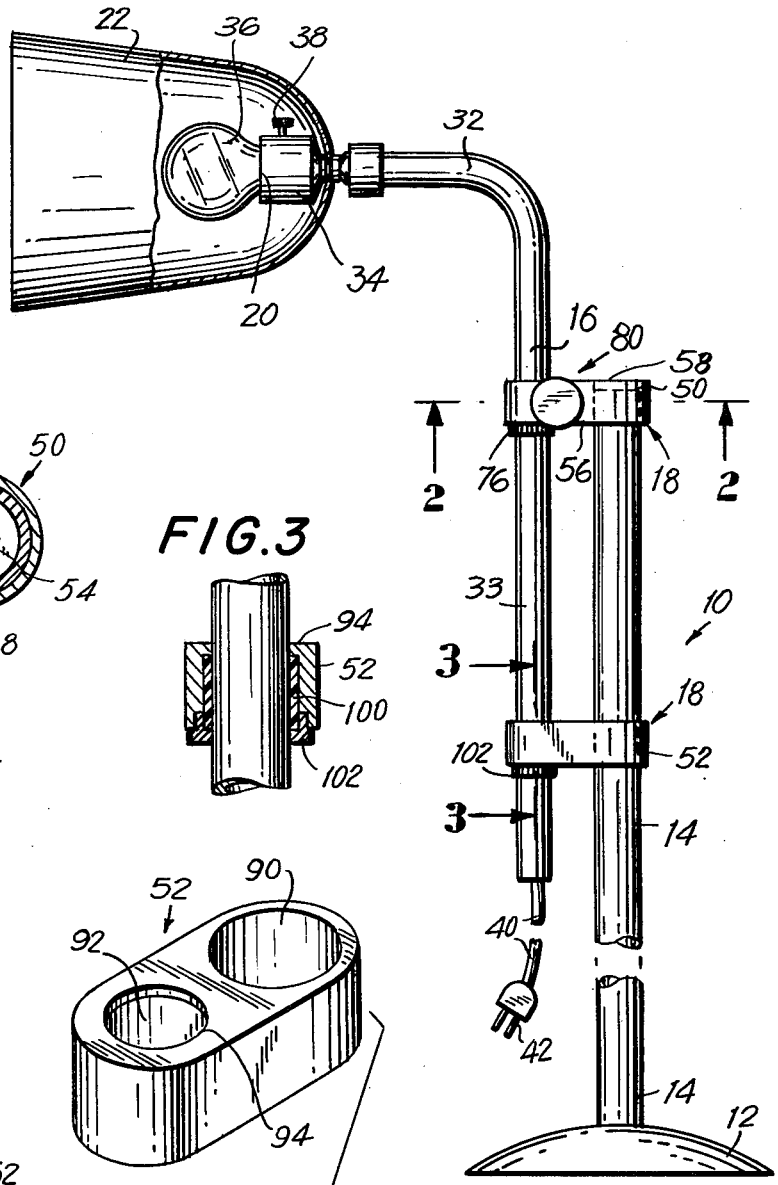
FIG. 2
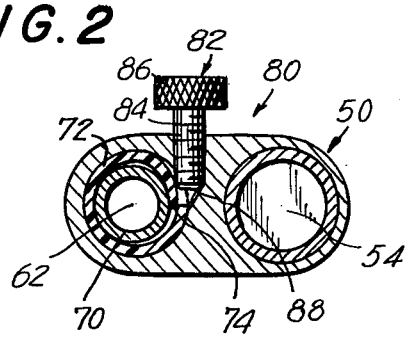
FIG. 3
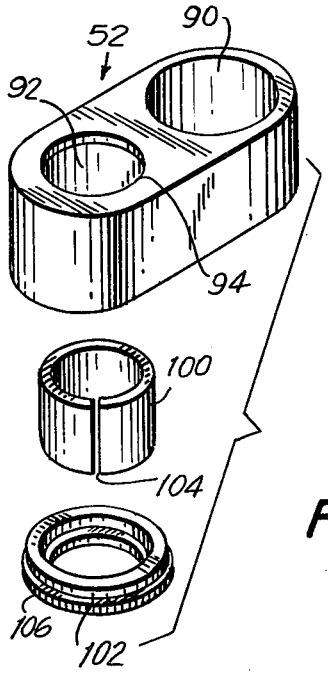
FIG. 4
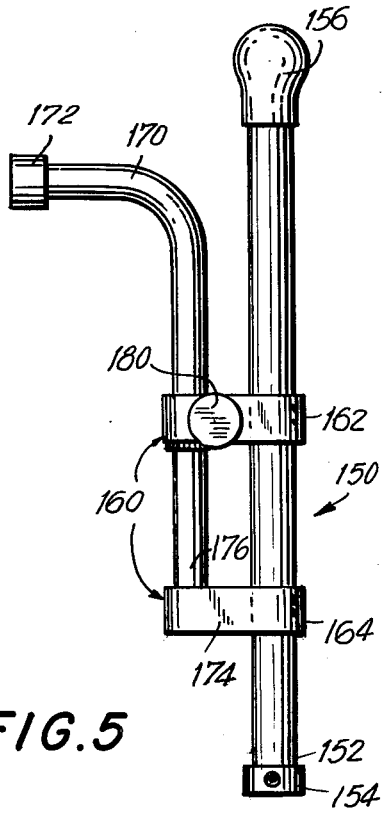
FIG. 5

SUPPORT ASSEMBLY FOR LAMP SWING ARM

BACKGROUND OF THE INVENTION-FIELD OF APPLICATION

This invention relates to supports for lamp swing arms; and more particularly to supports, for lamp swing arms, which facilitate rotation and height adjustment of the lamp swing arm and its light source.

BACKGROUND OF THE INVENTION-DESCRIPTION OF THE PRIOR ART

A considerable number of lamps are mounted to a wall bracket, floor base, table base, or the like which locates the light source in a relatively fixed position. Quite often a light source so positioned may not provide sufficient light to illuminate a desired area. Relocating the light source closer to the area to be illuminated is not always possible. Wall bracket mounted lamps are substantially immovable. Table base mounted lamps cannot be moved too far from a table and may be too heavy or cumbersome to move; while floor base mounted lamps may also be too heavy or cumbersome to relocate.

Adding more bulbs, a three-way bulb, or a bulb with greater wattage, may increase the amount of illumination; but only at a greater expense for the added electrical power. More importantly, it is not always more illumination that is desired; but sufficient illumination of a particular area.

Other available lamps provide a light source carried by a swing arm that permits rotation of the light source about a vertical axis; while still other lamps permit a vertical adjustment of the light source along the vertical axis in addition to the rotative movement of the light source about said axis. Obviously such lamps provide greater flexibility for relocating the light source than the previously mentioned types of lamps.

Such lamps, which permit both a vertical and rotative adjustment of the light source with respect to a selected axis usually include a swing arm support that incorporates a clutch or clamping device to facilitate positioning of the swing arm with respect to the support post for the swing arm. Supports of this type are shown: in U.S. Pat. No. 1,854,932 granted on Apr. 19, 1932 to M. E. Gottlieb for Reflector Lamp; in U.S. Pat. No. 3,185,838 granted on May 25, 1965 to J. Warshawsky for Friction Controlled Slidable And Rotatable Mounting For Lamps; and in U.S. Pat. No. 4,238,818 granted on Dec. 9, 1980 to A. Gindel for Nonrotatable Telescoping Supporting Structure. These supports, however, require rotation of a compression type nut to tighten and loosen the clutch or clamping device. Compression type nuts may prove difficult to grasp; especially if ones hand is relatively small. Insufficient tightening of, or an inability to properly tighten, a compression nut will result in slippage of the light support arm with respect to its support post and improper positioning of the light source. An inability to loosen such a compression nut will defeat the purpose of the support structure itself, i.e. the ability to re-position the light source on its support post. Additionally, such clamping devices may prove inefficient since they must convert an axially applied operating force into a radial clamping force.

Supports of the type shown in U.S. Pat. No. 641,748 granted on Jan. 23, 1900 to T. Smith for Adjustable Bracket require a relatively complex and costly split support clamp or housing construction which must be aligned for proper use; and wherein if one half of the clamp is lost, the entire support structure will be rendered useless.

Such available supports are also relatively short in their axial dimension, and thus provide support for only a relatively small portion of the arm or swing arm which supports the light source.

SUMMARY OF THE INVENTION

It is therefore an object of this invention to provide a new and improved lamp.

It is another object of this invention to provide a new and improved swing arm lamp.

It is yet another object of this invention to provide a new and improved support assembly for a lamp swing arm.

It is still another object of this invention to provide a new and improved clamping mechanism for the support assembly of a lamp swing arm.

It is yet still another object of this invention to provide a new and improved support housing arrangement for the support assembly of a lamp swing arm.

These and other objects and advantages of the present invention will become evident from the description which follows, which includes other objects, features, and advantages of the invention, in its details of construction and arrangement of parts, which will be seen from the following description of the preferred embodiment, when considered with the drawings, and from the appended claims.

BRIEF DESCRIPTION OF THE INVENTION

This invention involves a lamp having a light source carried by a swing arm that is, in turn, mounted on a support post by a swing arm support assembly which positions the swing arm for axial and rotational movement with respect to a swing arm axis and the support post; and contemplates forming the swing arm support assembly with spaced support housings to provide an extended support for the lamp swing arm, and providing the swing arm support assembly with a clamping device that incorporates a clamping ring, and a clamping ring actuator which is moved in a direction perpendicular to the swing arm axis of rotation to apply a radial force to the clamping ring which in turn grips the swing arm to secure the swing arm, and light source carried thereby, in position in the swing arm support and with respect to the support post.

The present invention thus generally entails the provision of a support assembly for a lamp swing arm, entailing a swing arm support housing which is formed with an upper housing assembly and a lower housing assembly. Each housing assembly includes a pair of openings spaced one from the other but each formed along parallel axes. One opening of the upper housing assembly extends into, but not through, the housing, and is of a size and configuration to be mounted on top of a lamp support post. The other opening of the upper housing assembly extends completely through the housing and is fitted proximate one of its ends with a clamping ring that has a longitudinal slit to permit distortion of the ring, proximate the slit and in a radial direction, to clamp same against the lamp swing arm or hold the swing arm in selected positions. A clamping actuator extends into the housing along an axis perpendicular to the axis of said openings and at a position proximate the second opening to co-act with the clamping ring proximate its slit to compress the ring against the lamp swing arm or release the ring therefrom. The lower housing assembly includes a guide ring to receive the lamp swing arm. The two housings are spaced from each other when mounted to the support post and when receiving the swing arm.

The present invention is thus basically characterized by the provision of a lamp swing arm support which includes first support housing means; a first opening extending into the first housing means along a first predetermined axis, and formed to a size and configuration to receive and be mounted to a lamp support post; a second opening extending through the first housing means along a second predetermined axis, and formed to a size and configuration to receive a lamp swing arm; a third opening extending into the first housing means along a third predetermined axis proximate the second opening and formed to size and configuration to receive a clamping actuator; a clamping ring disposed within the second opening and formed of a size and configuration to slidably receive the lamp swing arm and with a slit to facilitate radial movement of at least a predetermined portion of the clamping ring proximate the slit against the lamp swing arm to clamp same in selected positions; a clamping actuator movably received within the third opening and having an actuator end movable into engagement with the clamping ring proximate the slit to move the portion of the clamping arm when disposed therewithin to so clamp the lamp swing arm in the selected positions; second support housing means; a third opening extending into the second housing means along a third predetermined axis, and formed to a size and configuration to receive and be mounted to a lamp support post; a fourth opening extending through the second housing means along a fourth predetermined axis, and formed to a size and configuration to receive a lamp swing arm; a guide ring disposed within the fourth opening and formed of a size and configuration to slidably receive the lamp swing arm, and with a slit to facilitate radial movement of at least a predetermined portion of the guide ring against the lamp swing arm; and the first housing means and the second housing means being formed to be disposed in spaced relationship one with respect to the other when mounted to a lamp support post and when receiving a lamp swing arm.

In a preferred embodiment of the lamp swing arm support, the predetermined axes of the first and the second openings are parallel to one another. Typically in this case, the third predetermined axis is disposed at a predetermined angle with respect to the second predetermined axis. Preferably, the predetermined angle is 90°. In most instances, the first opening extends into, but not through, the support housing means. Generally, the clamping actuator includes a hand-turnable knob and a clamping shaft connected thereto, and threadably received in threads formed in the third opening. In this case, typically the clamping shaft is formed with a beveled forward edge disposed for co-action with an outer wall of the clamping ring.

In a more specific embodiment of the present support assembly for a lamp swing arm, the invention is characterized by the provision of a lamp, including a lamp base; a support post carried by the lamp base; a swing arm support assembly carried by the support post; a swing arm carried by the swing arm support assembly, for rotative and sliding movement with respect thereto; and a light source carried by the swing arm. The swing arm support assembly includes a first support housing; a first opening extending into the first housing along a first predetermined axis, and formed to a size and configuration to receive and be mounted to the support post; a second opening extending through the first housing along a second predetermined axis, and formed to a size and configuration to receive the swing arm; a third opening extending into the first housing along a third predetermined axis proximate the second opening, and formed to a size and configuration to receive a clamping actuator; a clamping ring disposed within the second opening, and formed of a size and configuration to slidably receive the swing arm, and with a slit to facilitate radial movement of at least a predetermined portion of the clamping ring proximate the slit against the swing arm, to clamp same in selected positions; and a clamping actuator movably received within the third opening and having an actuator end movable into engagement with the clamping ring proximate the slit, to move the portion of the clamping ring against the swing arm when disposed therewithin, to so clamp the swing arm in the selected portions; and a second support housing; a third opening extending into the second housing along a third predetermined axis, and formed to a size and configuration to receive and be mounted to the support post; a fourth opening extending through the second housing along a fourth predetermined axis, and formed to a size and configuration to receive the swing arm; a guide ring disposed within the fourth opening and formed of a size and configuration to slidably receive the swing arm; the first support housing and the second support housing being disposed in spaced relationship one with respect to the other, when so mounted to the support post, and when so receiving the swing arm. Typically, in a preferred embodiment of this configuration of the lamp swing arm support, the first predetermined axis of the first opening and the second predetermined axis of the second opening are parallel to one another. In this version of the invention, the third predetermined axis is usually disposed at a predetermined angle with respect to the second predetermined axis, and preferably the predetermined angle is 90°. Generally, the clamping actuator includes a hand-turnable knob, and a clamping shaft connected thereto, and threadably received in threads formed in the third opening. In this case, typically the clamping shaft is formed with a beveled forward edge disposed for co-action with an outer wall of said clamping ring.

The invention accordingly consists in the features of construction, combination of elements, and arrangement of parts, which will be exemplified in the device and article of manufacture hereinafter described, and of which the scope of application is as elucidated supra and as will be indicated in the appended claims.

BRIEF DESCRIPTION OF THE DRAWING

In the drawing:

FIG. 1 is an elevational view of a lamp incorporating the instant invention;

FIG. 2 is an enlarged sectional view taken along line 2—2 of FIG. 1;

FIG. 3 is an enlarged sectional view taken along line 3—3 of FIG. 2;

FIG. 4 is an enlarged exploded perspective view of the lower support housing assembly of the lamp of FIG. 1; and FIG. 5 is an elevational view of an alternate support post and lamp swing arm interconnected by the support assembly of this invention.

DESCRIPTION OF THE PREFERRED EMBODIMENT

For convenience, the invention will be described as applied to either a base mounted floor lamp or to an alternative lamp mounting means; each such mount includes a tubular support post of circular cross-section which mounts a swing arm support assembly that, in turn, carries a tubular swing arm of right angle configuration terminating in an end that may position a substantially conical shade and a light source therewithin. It should be understood, nevertheless, that without departing from the scope of this invention; that the lamp may be carried by a base and sized to be disposed upon a table, desk, pedestal or the like; that the support post need not be tubular or of circular cross-section; that the swing arm can terminate with any selected one of numerous configurations; and that the shade may also be of any desired configuration.

With reference to FIG. 1, there is generally shown at 10 a lamp having a base 12, a vertically extending support post 14, a swing arm 16, a swing arm support assembly 18 interconnecting said support post 14 and swing arm 16, a light source 20, and a shade 22.

Support post 14 is formed from tubular stock and of a suitable material such as brass, steel, aluminum or the like. Post 14 is of circular cross-section but may be of any other convenient cross-section; and may also be formed from solid bar stock where suitable. An appropriate finish may be applied to the outer surface of post 14. The lower end 30 of post 14 is secured by suitable means to base 12 which is fabricated from a suitable material compatible with that of support post 14.

Support post 14 has a larger outside diameter than swing arm 16 in the embodiment shown but may just as well be of the same diameter stock as swing arm 16.

Lamp swing arm 16 is also formed of tubular stock of circular cross-section, and of a material corresponding to the material used for support post 14. A first end 32, of swing arm 16, is bent into a right angle configuration with respect to a second end 33 of swing arm 16 and mounts a light source 20 in the form of a socket 34 and bulb 36. An appropriate and conventional electrical switch 38 is provided to turn light source 20 on and off, and to suitably connect socket 34, by way of electrical conductor 40 and a plug 42, to an appropriate source of electrical power. Electrical conductor 40 extends from light source 20 through swing arm 16 and second end 33 of swing arm 16.

Second end 33 of swing arm 16 is mounted to support post 14 through swing arm support assembly 18 (FIGS. 1–4). Support assembly 18 includes an upper housing assembly 50 and a lower housing assembly 52. Upper housing assembly 50 (FIGS. 1 and 2) is formed with a first opening 54 (FIG. 2) extending into housing 50 from a first end surface 56 thereof and terminating short of a second end surface 58 thereof to thereby close-off opening 54. Opening 54 proximate end surface 56 is internally threaded to receive external threads (not shown) formed on the upper extremity of support post 14. Opening 54 and post 14 need not be so threaded but post 14 may merely slip into opening 54 and seat beneath and up against end surface 58.

A second opening 62 is formed in upper housing assembly 50 but so as to extend completely through housing 50 from end surface 56 to end surface 58 thereof. Openings 54 and 62 have parallel and aligned axis; with opening 54 being of a larger diameter than opening 62 to receive post 14.

A clamping ring 70 is seated in opening 62 up against a circumferential shoulder 72 formed proximate end surface 58 of housing 50. The diameter of the opening provided by shoulder 72 is less than the outer diameter of ring 70 but greater than the inner diameter of ring 70 to thus permit free sliding and rotational movement of swing arm 16.

Clamping ring 70 is formed from a suitable plastic or other material and with an axial slit 74 (FIG. 2) that splits ring 70 and facilitates radial deformation of ring 70. An end ring 76 (FIG. 1) is press fit into opening 62 to secure clamping ring 70 in place. The exposed extremity of end ring 76 may be knurled around its periphery if desired.

Clamping ring 70 forms part of a clamping device 80 which coacts with swing arm 16 to retain same in position with respect to post 14. Clamping device 80 also includes a clamp actuator 82, formed with an externally threaded shaft 84 that is received in a suitably internally threaded opening extending into housing 50, and a knurled finger knob 86 to facilitate turning actuator 82. A forward end 88 (FIG. 2), of shaft 84 of actuator 82, is beveled and disposed to engage the outer wall of ring 70 proximate slit 74 thereof to thereby move that portion of ring 70 radially in towards swing arm 16 and against the surface thereof. When so moved with sufficient force swing arm 16 will be clamped in place within upper housing assembly 50 of support assembly 18 and thus located in a predetermined rotative and axial position.

It should be noted that the line of movement of shaft 84, of clamping device 80, is along an axis that will not intersect with the axis of rotation and longitudinal movement for swing arm 16; and that such line of movement for shaft 84 is spaced from the axis of swing arm 16 so that an appropriate force is applied to clamping ring 70 to easily move same against swing arm 16. Retrograde movement of actuator 80 will just as easily move end 84 of actuator 82 away from clamping ring 70 and permit the inherent resilience of ring 70 to move ring 70 back towards its circular configuration and away from swing arm 16.

Lower housing assembly 54 (FIGS. 1 and 4) is also formed with a pair of openings 90, 92 (FIG. 4) that have aligned and parallel axes. Opening 90 extends completely through housing assembly 52 and is of a larger diameter than opening 92 to accommodate and slidably receive post 14. Opening 92 terminates in a circumferential shoulder 94 (FIGS. 3 and 4) which acts as an upper seat and stop for a guide ring 100. An end ring 102 retains guide ring 100 in position within opening 92.

Guide ring 100 is formed with an axial slit 104 which splits ring 100 and permits radial compression thereof. Opening 90 is sized so that ring 100 is compressed sufficiently to receive swing arm 16 permitting swing arm 16 to be intentionally slid therethrough; but so as to establish sufficient friction so that ring 100, and lower housing assembly 52, will not move with respect to swing arm 16 under gravity alone. End ring 102 may be knurled about its perhiphery, as shown at 116 in FIG. 4, if so desired. If preferred, lower housing assembly 52 may be formed with a clamping device (not shown) such as clamping device 80. Guide ring 100 and end ring 102 are identical in construction with clamping ring 70 and end ring 76.

The relative positioning of upper housing assembly 50 with respect to lower housing assembly 52 is selected so that they are spaced by a selected distance that provides the maximum rigidity of swing arm 16 upon support post 14. The box-like arrangement established by upper housing assembly 50, lower housing assembly 52, and the portions of support post 14 and swing arm 16 disposed therebetween provides for a relatively rigid and secure structure when upper housing assembly 50 is clamped in place.

In use one need only turn actuating knob 82 in the appropriate direction to back off actuator shaft 84 and permit clamping ring 70 to release swing arm 16. Swing arm 16 may thereafter be rotated and moved axially. Lower housing assembly 52 will move along with any such movement of swing arm 16 due to the described coaction between guide ring 100 and swing arm 16. Thereafter, actuating knob 82 is turned in the opposite direction and clamping shaft 84 advances its end 88 against ring 70 to radially move same against swing arm 16 to clamp swing arm 16 and light source 20 in their selected position.

In the embodiment of FIG. 5, there is shown a support post 120 having a lower end 152 fitted with a connection fitting 154 to facilitate connecting post 150 to a floor base, table base, wall bracket or the like. Post 150 terminates at its upper end in a finial 156 but may be otherwise constructed. A swing arm support assembly 160 having an upper housing assembly 162 and a lower housing assembly 164 is carried by post 150 and, in turn, mounts a swing arm 170 formed with an end 172 to receive and mount a light source (not shown).

Lower housing assembly 164 is formed similar to lower housing assembly 52 of FIG. 4 with a first opening that permits passage therethrough of post 150, and with a second opening that receives swing arm 170. However, the second opening may either be closed at its end 174, or may be otherwise formed to receive and remain attached to an end 176 of swing arm 170 while permitting rotation thereof.

Upper housing assembly 162 includes a pair of openings more similar to those of lower housing assembly 52 of the FIG. 1 embodiments, than the upper housing assembly of such embodiment. That is, upper housing assembly 162 includes a pair of aligned openings that permit both support post 150 and swing arm 170 to pass completely therethrough. A clamping device 180 is provided for upper housing assembly 162; and is constructed with a clamping ring and clamping actuator identical in construction and operation to clamping device 80 of the embodiment of FIGS. 1–4. In all other respects post 150, swing arm 170 and support assembly 160 cooperates as described for similar elements of the embodiments of FIGS. 1–4.

From the above description, it will thus be seen that there has been provided a novel and improved support assembly for mounting the swing arm and light source of a lamp, to the support post thereof; which support assembly is relatively simple in construction and easy to operate, provides a relatively rigid mounting for the swing arm, and provides an effective radially acting force against a clamping ring to maintain the lamp swing arm and light source in any selected rotative and axial position.

It thus will be seen that there is provided a support assembly for a lamp swing arm which achieves the various objects of the invention, and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention, and it is understood that, although I have shown the preferred form of my invention, that various modifications may be made in the details thereof without departing from the spirit as comprehended by the following claims.

I claim:

1. A lamp swing arm support; comprising:

(a) first support housing means;

(b) a first opening extending into said first housing means along a first predetermined axis, and formed to a size and configuration to receive and be mounted to a lamp support post;

(c) a second opening extending through said first housing means along a second predetermined axis, and formed to a size and configuration to receive a lamp swing arm;

(d) a third opening extending into said first housing means along a third predetermined axis proximate said second opening and formed to a size and configuration to receive a clamping actuator;

(e) a clamping ring disposed within said second opening and formed of a size and configuration to slidably receive the lamp swing arm and with a slit to facilitate radial movement of at least a predetermined portion of said clamping ring proximate said slit against the lamp swing arm to clamp same in selected positions;

(f) a clamping actuator movably received within said third opening and having an actuator end movable into engagement with said clamping ring proximate said slit to move said portion of said clamping arm when disposed therewithin to so clamp the lamp swing arm in said selected positions;

(g) second support housing means;

(h) a third opening extending into said second husing means along a third predetermined axis, and formed to a size and configuration to receive and be mounted to a lamp support post;

(i) a fourth opening extending through said second housing means along a fourth predetermined axis, and formed to a size and configuration to receive a lamp swing arm;

(j) a guide ring disposed within said fourth opening and formed of a size and configuration to slidably receive the lamp swing arm and with a slit to facilitate radial movement of at least a predetermined portion of said guide ring against the lamp swing arm; and (k) said first housing means and said second housing means being formed to be disposed in spaced relationship one with respect to the other when mounted to a lamp support post and when receiving a lamp swing arm.

2. The lamp swing arm support of claim 1, wherein said predetermined axes of said first and said second openings are parallel to one another.

3. The lamp swing arm support of claim 2, wherein said third predetermined axis is disposed at a predetermined angle with respect to said second predetermined axis.

4. The lamp swing arm support of claim 3, wherein said predetermined angle is ninety degrees.

5. The lamp swing arm support of claim 1, wherein said first opening extends into but not through said support housing means.

6. The lamp swing arm support of claim 1, wherein said clamping actuator includes a hand turnable knob and a clamping shaft connected thereto and threadably received in threads formed in said third opening.

7. The lamp swing arm support of claim 6, wherein said clamping shaft is formed with a beveled forward edge disposed for coaction with an outer wall of said clamping ring.

8. A lamp; comprising:

(a) a lamp base;

(b) a support post carried by said lamp base;

(c) a swing arm support assembly carried by said support post;

(d) a swing arm carried by said swing arm support assembly for rotative and sliding movement with respect thereto;

(e) a light source carried by said swing arm;

(f) said swing arm support assembly including:

(i) a first support housing;

(ii) a first opening extending into said first housing along a first predetermined axis, and formed to a size and configuration to receive and be mounted to said support post;

(iii) a second opening extending through said first housing along a second predetermined axis, and formed to a size and configuration to receive said swing arm;

(iv) a third opening extending into said first housing along a third predetermined axis proximate said second opening and formed to a size and configuration to receive a clamping actuator;

(v) a clamping ring disposed within said second opening and formed of a size and configuration to slidably receive said swing arm and with a slit to facilitate radial movement of at least a predetermined portion of said clamping ring proximate said slit against said swing arm to clamp same in selected positions; and (vi) a clamping actuator movably received within said third opening and having an actuator end movable into engagement with said clamping ring proximate said slit to move said portion of said clamping ring against said swing arm when disposed therewithin to so clamp said swing arm in said selected portions;

(vii) a second support housing;

(viii) a third opening extending into said second housing along a third predetermined axis, and formed to a size and configuration to receive and be mounted to said support post;

(ix) a fourth opening extending through said second housing along a fourth predetermined axis, and formed to a size and configuration to receive said swing arm;

(x) a guide ring disposed within said fourth opening and formed of a size and configuration to slidably receive said swing arm;

(xi) said first support housing and said second support housing being disposed in spaced relationship one with respect to the other when so mounted to said support post and when so receiving said swing arm.

9. The lamp swing arm support of claim 8, wherein said first predetermined axis of said first opening and said second predetermined axis of said second opening are parallel to one another.

10. The lamp swing arm support of claim 9, wherein said third predetermined axis is disposed at a predetermind angle with respect to said second predetermined axis.

11. The lamp swing arm support of claim 10, wherein said predetermined angle is ninety degrees.

12. The lamp swing arm support of claim 11, wherein said clamping actuator includes a hand turnable knob and a clamping shaft connected thereto and threadably received in threads formed in said third opening.

13. The lamp swing arm support of claim 12, wherein said clamping shaft is formed with a beveled forward edge disposed for coaction with an outer wall of said clamping ring.

* * * * *